US005772955A

United States Patent [19]

Hanniala et al.

[11] Patent Number: 5,772,955

[45] Date of Patent: Jun. 30, 1998

[54] APPARATUS FOR SUSPENSION SMELTING

[75] Inventors: Pekka Hanniala; Risto Saarinen, both of Espoo; Erkki Krogerus; Ilkka Kojo, both of Kirkkonummi, all of Finland

[73] Assignee: Outokumpu Engineering Contractors OY, Finland

[21] Appl. No.: 671,959

[22] Filed: Jun. 28, 1996

Related U.S. Application Data

[62] Division of Ser. No. 373,983, Jan. 18, 1995, Pat. No. 5,565,016.

[30] Foreign Application Priority Data

Feb. 17, 1994 [FI] Finland ..... 940739

[51] Int. Cl.[6] ..... C22B 5/12

[52] U.S. Cl. ..... 266/182; 222/592; 266/193

[58] Field of Search ..... 266/182, 191, 266/190, 193; 222/592

[56] References Cited

U.S. PATENT DOCUMENTS 4,498,610 2/1985 Wooding ..... 222/592
5,040,773 8/1991 Hackman ..... 222/592

FOREIGN PATENT DOCUMENTS 1212191 11/1970 United Kingdom ..... 75/643

*Primary Examiner*—Melvyn Andrews
*Attorney, Agent, or Firm*—Brooks Haidt Haffner & Delahunty

[57] ABSTRACT

The invention relates to an apparatus for the suspension smelting of sulfidic, finely divided raw materials containing metals, such as copper, nickel and lead, by using oxygen enrichment. In this method into the suspension smelting furnace (1) there is fed the raw material (4,5) to be smelted together with flux (6) and oxidizing gas (7) and the walls (18) of the reaction space of the suspension smelting furnace are cooled and at least two molten phases created (16,17). According to the invention the degree of oxygen enrichment of the oxidizing gas is at least 40% in order to raise the temperature of the particles in suspension to at least 200° C. higher than the temperature of the gas phase of the suspension, in order to improve the reaction kinetics of the reactions taking place in the reaction space, and that the thickness of the reaction space wall lining is adjusted, according to the production quantity of the suspension smelting furnace, by means of cooling elements (20) manufactured by draw casting and installed in the wall of the reaction space.

3 Claims, 2 Drawing Sheets

APPARATUS FOR SUSPENSION SMELTING

CROSS REFERENCE TO RELATED APPLICATION

This application is a division of our prior application Ser. No. 373,983, filed Jan. 18, 1995 now U.S. Pat. No. 5,565,016.

BACKGROUND OF THE INVENTION

1. Field of the Invention

The present invention relates to a method and apparatus for the suspension smelting of sulfidic raw materials containing metals, such as copper, nickel and lead, when a high degree of oxygen enrichment is employed in the oxidizing gases to be fed in the smelting unit in order to raise the temperature of the particles in suspension.

2. Description of the Related Art

In traditional suspension smelting, the finely divided sulfidic raw material containing metals such as copper, nickel and lead, the recirculated flue dust and fluxes, as well as the air and/or oxygen mixture to be used as the oxidizing gas, either preheated or cold, are conducted to the vertical reaction shaft of a suspension smelting furnace from top to bottom, so that the oxidizing reactions take place at a high temperature. Owing to the influence of reaction heat and possible additional fuel, the major part of the reaction products will melt. From the reaction shaft the suspension falls into the horizontal part of the furnace, i.e. to the settler, which contains at least two but sometimes three molten layers. If the settler contains three molten layers, the lowermost layer is the raw metal layer. Most often there are only two layers in the furnace: lowermost the matte or metal layer, and the slag layer on top of it. The majority of the molten or solid particles in suspension falls directly to the melt located underneath the reaction shaft at roughly the slag temperature, and the most finely divided ingredients continue along with the gases towards the other end of the furnace. All along the way, the suspension particles are settled into the melt of the settler. From the other end of the settler, the exhaust gases are conducted directly up through the uptake shaft of the suspension smelting furnace, wherefrom the gases are further conducted to a gas processing arrangement comprising a waste heat boiler and an electrofilter. Generally the smelting in the suspension smelting furnace is attempted to be carried out as autogeneously as possible, without external fuel, by preheating and/or oxygen enriching the oxidizing gas to be fed into the reaction space.

The reactions that are started in the reaction space, i.e. reaction shaft of the suspension smelting furnace, are completed after the particles have fallen into the melt contained in the settler of the suspension smelting furnace. In order to compensate heat losses and to provide for the settler reactions, oil is fed into the settler through burners connected to the walls, both to underneath the reaction shaft and to other parts of the settler. The burning of oil does, however, increase the water content in the gas discharged from the suspension smelting furnace, which is harmful with respect to further treatment of the gas. At the same time the total amount of gas discharged from the suspension smelting furnace increases, because air is used in the combustion. The high total gas amount also reduces the smelting capacity in suspension smelting, which further increases the operation costs of suspension smelting, as well as the total costs thereof.

In addition to the most finely divided particle fraction of suspension, also those particles that did not react and melt in the reaction shaft tend to follow the gas flow out of the suspension smelting furnace, because their area/weight ratio is higher than that of the molten particles. The particles are separated from the gas phase in the exhaust gas processing arrangement, in the waste heat boiler and electrofilter, together with the most finely divided particle fraction of the suspension. In the gas processing arrangement, the separated solids, i.e. flue dust, are returned to the suspension smelting furnace. The recirculation of flue dust increases the energy demand in the reaction shaft of the suspension smelting furnace, which demand is normally covered by feeding additional fuel. An increased use of additional fuel increases the total gas amount in the suspension smelting furnace and reduces the molten amount of the original sulfidic raw material.

The object of the present invention is to eliminate some of the drawbacks of the prior art and to achieve an improved method and apparatus for the suspension smelting of sulfidic raw materials containing metals, such as copper, nickel and lead, so that the reactions taking place in the reaction shaft of the suspension smelting furnace, as well as the melting of the particles, can advantageously be completed before the particles fall into the settler of the suspension smelting furnace.

SUMMARY OF THE INVENTION

According to the invention, in order to improve the kinetics of the reactions taking place in the reaction space of a suspension smelting furnace, the employed oxidizing gas in suspension smelting is technical oxygen, with an air ratio of 75% at the most. Thus the degree of oxygen enrichment is at least 40%. The high degree of oxygen enrichment advantageously enhances the kinetics of the reactions taking place in the reaction space of the suspension smelting furnace, because the driving force in these reactions, i.e. the partial oxygen pressure, is high, particularly at the beginning of the reactions. Therefore the reactions are carried out rapidly, and the heat released in these reactions can be utilized for melting particles and for proceeding the reactions to a higher degree than with external heating, i.e. use of additional fuel. The temperature of these particles is essentially higher than in the surrounding gas phase. The use of energy, obtained by increasing the partial oxygen pressure by means of oxygen enrichment, is consequently different from the use of energy obtained by burning additional fuel, because the purpose of using additional fuel is to heat the particles by means of the hot gas phase. Owing to the advantageous particle temperature obtained by applying the present invention, the amount of recirculated flue dust also is reduced, because the probability of occurrence of nonreacted and unmelted particles is reduced. Consequently, the original sulfidic raw material can be fed into the reaction space of the suspension smelting furnace to a higher extent than before, which in part increases the production of the suspension smelting furnace as for matte or raw metals.

Owing to an advantageous temperature difference between the particles and the gas phase, the average temperature of the suspension does not increase to such an extent that would happen if the corresponding growth in the reaction level were achieved by using additional fuel. However, particularly in the reaction zone, where the reactions happen most rapidly, the walls of the reaction space are subject to more intensive thermal strain than before, owing to the increase of the temperature of the particles, and to increased thermal radiation. Because of the thermal strain directed to the walls of the reaction space of the suspension smelting furnace of the invention, the walls of the reaction space are advantageously cooled, so that in the walls there are installed cooling elements made of copper, in which elements the cooling medium flows in enforced circulation. According to the invention, the cooling elements employed in the walls of the reaction space are manufactured by draw casting. Thus the structure of the casting product is essentially homogeneous, as compared to mould casting, for instance, where—due to intensive segregation—the impurities that weaken the conductive capacity of the copper tend to concentrate at certain points of the cast piece. In the cooling elements manufactured by draw casting, the majority of the channels of the cooling medium are created already when manufacturing the cooling element of the casting material proper. In that case, essential heat transfer obstacles are not created in between the cooling element and the flowing cooling medium, as may be the case for instance when producing sand-cast elements, when cooled copper pipes are used during casting in order to form the cooling medium channels.

When employing draw-cast cooling elements according to the invention, owing to the essentially homogeneous casting quality and to the heat transfer properties of the cooling medium channels, the heat transfer capacities achieved in the whole cooling element are advantageously such, that the distance of the cooling medium channels from the surface of the cooling element that gets into contact with the high temperature is increased. Advantageously the distance between the cooling medium channel that falls nearest to the high temperature, and the surface of the cooling element that falls nearest to the high temperature is at least 40% of the distance between the surface of the cooling element that falls nearest to the interior of the reaction space, and the surface of the cooling element that falls nearest to the frame structure. Now the danger that the cooling medium channel should burst is essentially reduced, and the cooling element longer endures possible interruptions in the flowing of the cooling medium, caused by erroneous operation. Furthermore, the cooling element is attached to the wall of the reaction space so that the when necessary, the cooling element can be replaced in an essentially short time without cooling the furnace. The protection of the reaction space of the suspension smelting furnace by means of cooling is based on the fact that owing to the cooling arranged according to the invention, on the interior wall of the reaction space, there is formed an autogenic lining of slag and in part possibly of metal and/or matte, which autogenic lining protects the fireproof lining proper of the reaction space as well as the cooling elements against thermal, chemical and mechanical strain. The created autogenic lining also serves as insulation, thus reducing the heat losses in the reaction shaft.

However, the reaction space of a suspension smelting furnace is susceptible to a changing heat load both in terms of time and location. In a continuous mass production process, the suspension smelting furnace is run mainly with full capacity. In some cases, however, it is necessary—for instance during smaller repairs—to cut the production down. Now, when running with a smaller production quantity, the heat strain in the reaction space also is reduced. If the heat losses were of the same magnitude as with full-scale production, this would mean that the reactions take place at a lower temperature. When employing the method and apparatus of the invention, the thickness of the insulating autogenic lining can be adjusted, so that with large production quantities, the layer is thinner, and consequently the insulating effect weaker. When the suspension smelting furnace is run with a lower production quantity, the relative cooling effect of the cooling elements grows, and the thickness of the autogenic lining grows likewise; thus the insulating effect of the autogenic lining is stronger, and heat losses smaller.

The high oxygen enrichment applied according to the invention improves the operation of the suspension smelting furnace in that with high oxygen enrichment, the heat is created in the reactions between the sulfide particles and oxygen, wherein heat is released where it is particularly needed. Thus, in the suspension phase flowing in the reaction space, exactly the particles to be melted are at a higher temperature than the gas phase, so that the temperature difference between the particles and the gas phase is at least 200° C. The high temperature of the particles to be melted enables a completely autogeneous melting, in which there is no need for additional fuel in the reaction shaft. If, however, additional fuel is used, for example when the production quantity of oxygen is a limiting factor, the demand of additional fuel in the reaction shaft for melting the particles is essentially small in comparison to the state-of-the-art solutions.

Due to the high temperature of the particles, also the temperature of the molten phases separated from each other in the settler is high, which in part reduces the need for additional fuel in the settler. When necessary, the additional fuel is burned in a burner, at least one, installed in the top part of the settler, advantageously in the ceiling of the settler, so that the burner, directed from above towards the settler melt and the settler gas flow helps, by means of the gas flow created thereby, the dust contained in the gas phase to be separated therefrom by forcing the main gas flow of the settler towards the molten phase. Thus the gas flow created by the burner helps the particles collide and fall into the molten phase.

The high reaction-space temperature of the particles to be melted, achieved by the method of the present invention, also helps the solid and molten phases be separated from the gas phase in the horizontal part of the suspension smelting furnace, i.e. in the settler. Owing to the high temperature, the majority of the particles of the gas suspension coming from the reaction space are in molten state, so that the weight to area ratio of the particles is advantageous for the separation of the gas phase. The high temperature of the particles, achieved in the reaction space, further leads to a situation in the settler where the temperature of both slag and matte, as well as that of the raw metal phase possibly produced in the furnace, is essentially higher immediately below the reaction space, where an essential part of the particles is separated from the gas phase. It is pointed out that according to the laws of nature, the different particle size fractions react at different velocities in the suspension, so that part of the particles may be in underoxidized state with respect to the thermodynamic balance, whereas at least smaller particles may react faster to oxides. This is based on the fact that is when the particles melt, the factor adjusting the reaction velocity is the diffusion in the molten phase, instead of a situation where the reaction velocity is adjusted by the material transfer between the gas phase and the molten phase of the particle, which material transfer means that oxygen is shifted from the surrounding gas phase to the particle, and the reaction products are shifted from the surface layers of the particle to the gas phase. In the part of the settler that is located underneath the reaction space, the reactions that took place in the reaction space are balanced essentially rapidly due to the high temperature achieved according to the present invention, because in principle the higher the temperature, the higher the reaction velocity.

In the part of the settler that is located underneath the reaction space of the suspension smelting furnace, the temperature of the molten phases is advantageously high and hence viscosity low, and therefore the molten phases are separated rapidly and the reactions in between the molten phases are rapidly arranged near the state of thermodynamic balance. The molten phases created in the settler, i.e. slag and matte or slag and raw metal, are tapped from the settler at the uptake-shaft end of the settler, in which case the molten phases have essentially sufficient time to be separated without having to keep the molten surface of the settler high. Thus the molten phases can be let out of the settler in an essentially continuous fashion, so that the surface of the melt also can be kept on an essentially constant level in the settler. Thus the height of the gas space in the settler also advantageously remains constant, which leads to an essentially smooth gas flow through the settler. The smooth gas flow is further advantageous for the separation of particles from the gas phase, before the gas phase is discharged from the furnace space proper.

By employing the method and apparatus of the invention, the capacity of a suspension smelting furnace can be raised, or respectively a suspension smelting furnace, particularly the settler of a suspension smelting furnace, can be made smaller in measure, at least in width and in height. In similar fashion, owing to a smooth gas flow, the gas processing apparatus can be designed and measured smaller. Furthermore, the cooling of the suspension smelting furnace according to the method of the invention results in that the need to renew the lining of the reaction space is essentially reduced, and the smelting process taking place in the suspension smelting furnace does not have to be interrupted for the renewal of the linings.

BRIEF DESCRIPTION OF THE DRAWINGS

The invention is explained in more detail below, with reference to the appended drawings, where.

DESCRIPTION OF THE PREFERRED EMBODIMENT

Figure 1:
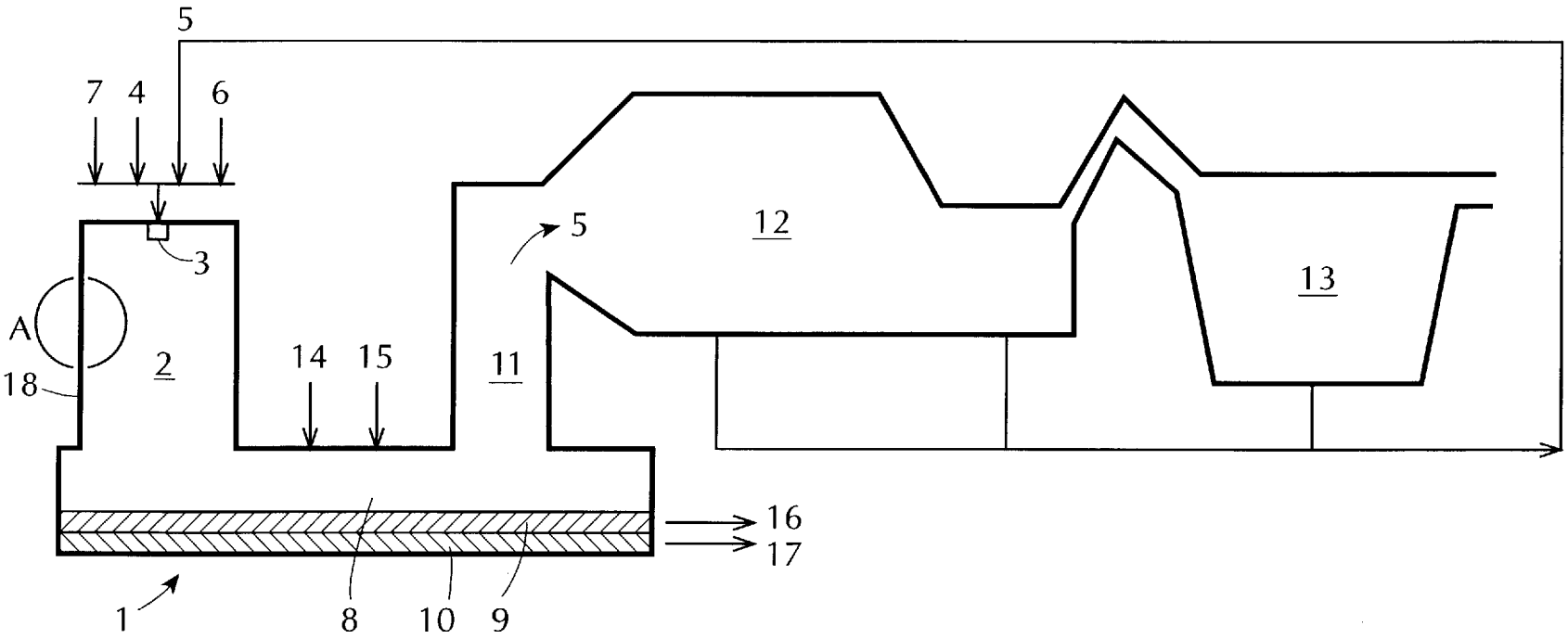
FIG. 1 is a side-view illustration of a preferred embodiment of the invention.

According to FIG. 1, into the reaction shaft 2 of a suspension smelting furnace 1, there is fed, by means of a concentrate burner 3, finely divided raw material 4 containing sulfidic metals such as copper, or copper and nickel, flue dust 5 recirculated from the suspension smelting furnace, flux 6 and oxidizing gas 7, with a 45% degree of oxygen enrichment. According to the invention, due to the high degree of oxygen enrichment in the reaction shaft 2 there are advantageously created such conditions that in the reaction shaft 2, the finely divided sulfide particles reach a temperature that is higher than that of the surrounding gas phase. The high temperature of the particles enhances the melting thereof, and further the separation of the molten particles from the gas phase. Simultaneously with the reactions between the gas phase and the particles, the different phases are settled in the reaction shaft 2 towards the horizontal part, i.e. settler 8 of the suspension smelting furnace 1. In the settler 8, the separation of the molten phases—slag 9 and matte or raw metal 10—from the gas phase continues, so that on the bottom of the settler 8 there are formed separate molten phases 9 and 10, as is illustrated in FIG. 1. The gas phase and the unmelted solid particles contained therein proceed, via the uptake shaft 11 of the suspension smelting furnace 1 to the gas processing arrangement, the waste heat boiler 12 and the electrofilter 13. In the waste heat boiler 12 and the electrofilter 13, solid particles are separated from the gas phase and returned as flue dust 5 to be used as the feed for the suspension smelting furnace 1. Owing to the sulfur dioxide contained in the gas phase, the gas phase as such can be used for instance as the raw material of sulfuric acid.

In order to separate the molten particles as efficiently as possible from the gas phase, additional fuel can be fed into the settler 8 of the suspension smelting furnace 1, advantageously through at least one burner 15 located in the ceiling 14 of the settler. The molten phases 9 and 10 created in the settler 8 are removed from the settler 8 through discharge outlets 16 and 17 installed at that end of the suspension smelting furnace that is located on the side of the uptake shaft 11 therof, in an essentially continuous process, by using in connection with the discharge outlets 16 and 17 a molten flow equalizer operated for instance according to the siphon principle.

Figure 2:
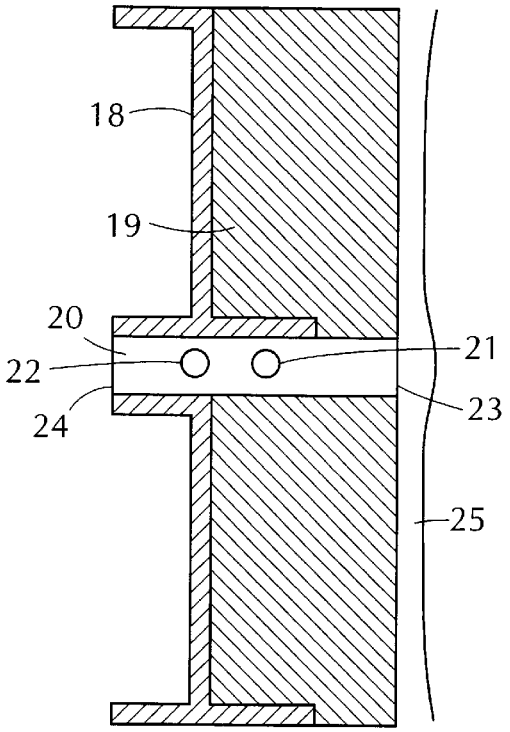
FIG. 2 is a detail of the wall of the suspension smelting furnace of the embodiment of FIG. 1, seen at the cross-section A.

Owing to the high degree of oxygen enrichment of the oxidizing gas 7 fed into the reaction shaft 2 of the suspension smelting furnace, the reaction temperatures are high in the reaction shaft 2. Therefore in the frame structure 18 of the wall of the reaction shaft 2, there is installed, according to FIG. 2, in between the brick lining 19, in an essentially horizontal position, at least one cooling element 20, which is manufactured by draw casting. The cooling element 20 contains cooling channels 21 and 22 for the flowing of the cooling medium. The flow channel 21 located nearest to the inner part of the reaction shaft 2 is located so that the distance of the flow channel 21 from the end 23 nearest to the inner part of the reaction shaft 2 is at least 40% of the distance between the end 23 of the cooling element 20 nearest to the inner part of the reaction shaft 2 and the end 24 nearest to the frame structure 18 of the reaction shaft. Further, FIG. 2 illustrates the autogenic lining, marked with reference number 25, formed in the wall of the reaction shaft 2 during the suspension smelting process, the said lining containing components that participate in the reactions in the reaction shaft 2. According to the invention, the thickness of the autogenic lining 25 can advantageously be adjusted on the basis of the production quantity of the matte or raw metal created in the suspension smelting furnace 1.

Figure 3A:
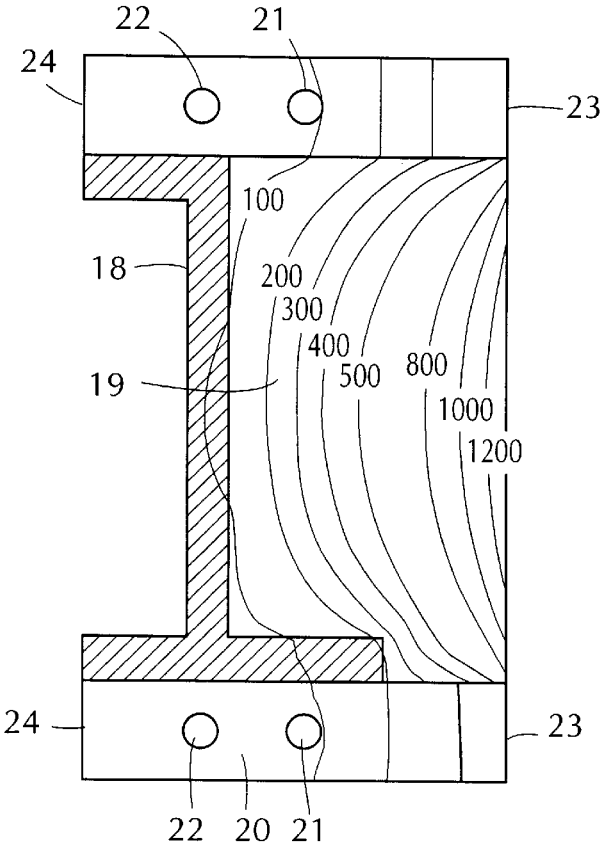
FIG. 3*a* is an illustration of the temperature profile in the wall of the suspension smelting furnace, created by the cooling element of FIG. 2.
Figure 3B:
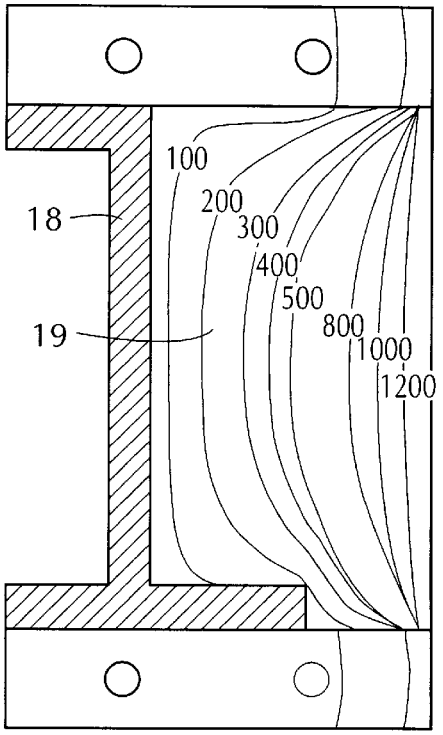
FIG. 3*b* is an illustration of a corresponding temperature profile as in FIG. 3*a*, now created by a state-of-the-art cooling element.

The curves illustrated in FIGS. 3*a* and 3*b* describe the limit curves of different temperatures. Thus for instance the curve described with the number 1,000 illustrates the temperature 1,000° in between two cooling elements. From FIGS. 3*a* and 3*b* it is observed that in the region of the furnace wall lining 19, the temperature profiles essentially correspond to each other. In this case it is thus advantageous to use the cooling element 20 of the invention, illustrated in FIG. 3*a*, because on the basis of the location of the flow channel 21, the cooling element 20 endures possible interference situations created in the cooling of the suspension smelting furnace better than a state-of-the-art cooling element. This reduces the danger that the flow channel of the cooling element 20 should burst.

We claim:

1. A furnace for suspension smelting sulfidic finely divided materials, the furnace comprising walls defining a reaction space; means for feeding, respectively, finely divided solid raw material containing metal to be smelted, flux, and oxidizing gas; means for removing molten phases created in the furnace and a gas phase; means for cooling at least the walls of the reaction space; and means for feeding additional fuel, wherein the walls comprise a frame with a reaction shaft side toward the interior of the reaction space and a frame side away from the interior of the reaction space and wherein there is attached to the frame at least one cooling element being essentially homogeneous and manufactured by draw casting.

2. A furnace according to claim 1 wherein the cooling element is copper.

3. A furnace apparatus according to claim 1 or 2, wherein the cooling element comprises two cooling channels, one channel being closer to the reaction shaft side and the other channel being closer to the frame side, the distance of the reaction shaft side cooling channel being at least 40% of the total distance between the end of the cooling element nearest to the reaction shaft and the end nearest to the frame side of the reaction shaft.

* * * * *